US006821215B2

(12) United States Patent
Sajima

(10) Patent No.: US 6,821,215 B2
(45) Date of Patent: Nov. 23, 2004

(54) GOLF BALL

(75) Inventor: Takahiro Sajima, Kobe (JP)

(73) Assignee: Sumitomo Rubber Iindustries, Ltd., Kobe (JP)

( * ) Notice: Subject to any disclaimer, the term of this patent is extended or adjusted under 35 U.S.C. 154(b) by 115 days.

(21) Appl. No.: 10/216,872

(22) Filed: Aug. 13, 2002

(65) Prior Publication Data

US 2003/0045379 A1 Mar. 6, 2003

(30) Foreign Application Priority Data

Aug. 21, 2001 (JP) ..... 2001-249899

(51) Int. Cl.[7] ..... A63B 37/12
(52) U.S. Cl. ..... 473/382
(58) Field of Search ..... 473/379–383

(56) References Cited

U.S. PATENT DOCUMENTS 4,813,677 A 3/1989 Oka et al.
5,080,367 A 1/1992 Lynch et al.
5,156,404 A * 10/1992 Oka et al. ..... 473/382
5,292,132 A 3/1994 Oka
5,735,756 A * 4/1998 Stiefel et al. ..... 473/382

* cited by examiner

*Primary Examiner*—Raeann Gorden
(74) *Attorney, Agent, or Firm*—Birch, Stewart, Kolasch & Birch, LLP

(57) ABSTRACT

A golf ball includes, on a surface thereof, a first dimple (1) having a diameter of 4.50 mm, a second dimple (2) having a diameter of 4.00 mm, a third dimple (3) having a diameter of 3.60 mm, a fourth dimple (4) having a diameter of 2.80 mm and a fifth dimple (5) having a diameter of 2.30 mm. A region surrounded by a circle (C) in a phantom spherical surface is a crown portion and other region are non-crown portion. The total area of the crown portions and that of the on-crown portion are equal to each other. The difference between a dimple occupation ratio Yc (%) in the crown portions and a dimple occupation ratio Yn (%) in the non-crown portion is 5% to 30%.

7 Claims, 5 Drawing Sheets

GOLF BALL

BACKGROUND OF THE INVENTION

1. Field of the Invention

The present invention relates to a golf ball and more particularly to a dimple pattern on a golf ball.

2. Description of the Related Art

A golf ball has approximately 300 to 550 dimples on its surface. The role of the dimples resides in one aspect that such dimples disturb the air stream around the golf ball during its flight to accelerate the transition of turbulent flow at a boundary layer of the golf ball, thereby causing a turbulent flow separation (which will be hereinafter referred to as the "dimple effect"). The acceleration of the transition of the turbulent flow causes a separating point of air from the golf ball to be shifted backward so that the pressure resistance is reduced. Moreover, the acceleration of the transition of the turbulent flow increases a differential between upper and lower separating points of the golf ball which is caused by back spin. Consequently, the lift acting on the golf ball is increased. By a reduction in the pressure resistance and an enhancement in the lift, the flight distance of the golf ball is increased. A dimple pattern capable of readily promoting the transition of the turbulent flow, that is, a dimple pattern capable of effectively disturbing the air stream is more aerodynamically excellent.

There have been proposed various golf balls having improved dimple patterns in order to enhance a flight performance. For example, Japanese Patent Publication No. Sho 58-50744 (U.S. Pat. No. 5,080,367) has disclosed a golf ball in which dimples are densely provided such that a pitch between the dimples is 1.62 mm or less if possible. Moreover, Japanese Laid-Open Patent Publication No. Sho 62-192181 (U.S. Pat. No. 4,813,677) has disclosed a golf ball in which dimples are densely provided so as not to form a new dimple having an area which is equal to or larger than a mean area in a land portion other than the dimples. Furthermore, Japanese Laid-Open Patent Publication No. Hei 4-347177 (U.S. Pat. No. 5,292,132) has disclosed a golf ball in which dimples are provided very densely such that the number of land portions in which a rectangle having a predetermined dimension can be drawn is 40 or less.

All the golf balls disclosed in the known publications have densely provided dimples, in other words, the surface area occupation ratio of the dimple is increased. Those skilled in the art have recognized that the surface area occupation ratio is one of important elements for influencing the dimple effect.

The most important performance required for the golf ball by a golfer is flight performance. A long flight distance gives the golfer a refreshing feeling, and furthermore, contributes to an enhancement in the score. While a golf ball having its surface area occupation ratio increased exhibits an excellent flight performance, the golfer desires a further enhancement in the flight distance.

SUMMARY OF THE INVENTION

The present invention provides a golf ball having a large number of dimples on a surface thereof. In the golf ball, when a plurality of crown portions distributed over a phantom spherical surface of the golf ball are assumed to have a total area which is one-half of the area of the phantom spherical surface, the difference between the dimple occupation ratio Yc (%) in the crown portions and a dimple occupation ratio Yn (%) in a non-crown portion is 5% to 30%.

In the golf ball, the difference between the dimple occupation ratio Yc (%) and the dimple occupation ratio Yn (%) is greater than that of an ordinary golf ball. In other words, the dimples are dense in one of the crown portions and in a non-crown portion and are sparse in others. In the golf ball, the region in which the dimples are dense and the region in which the dimples are sparse appear alternately by backspin during flight. Consequently, the dimple effect of disturbing an air stream is promoted so that the flight distance of the golf ball can be increased.

Preferably, the areas of all the crown portions are equal to each other and dimple patterns in all the crown portions are almost equivalent to each other. The golf ball is excellent in aerodynamic symmetry.

With respect to aerodynamic symmetry, it is preferable that the crown portions be distributed as uniformly as possible. More specifically, it is preferable to obtain a golf ball in which all the crown portions are present in positions corresponding to the vertexes of a regular polyhedron inscribed in the phantom spherical surface. Moreover, the latitudes of all the crown portions excluding the crown portions positioned on the poles may be identical to each other.

It is preferable that a surface area occupation ratio Y is 70% to 90%. As described above, the dimples are comparatively sparse in one of the crown portions and in the non-crown portion. Also in this case, the surface area occupation ratio Y is set within the range. Consequently, the dimple effect of the whole golf ball can be prevented from being reduced. The expression "surface area occupation ratio," as used in this specification, implies a ratio of the total dimple area to the area of the phantom spherical surface.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

The present invention will be described below in detail based on a preferred embodiment with reference to the drawings.

Figure 1:
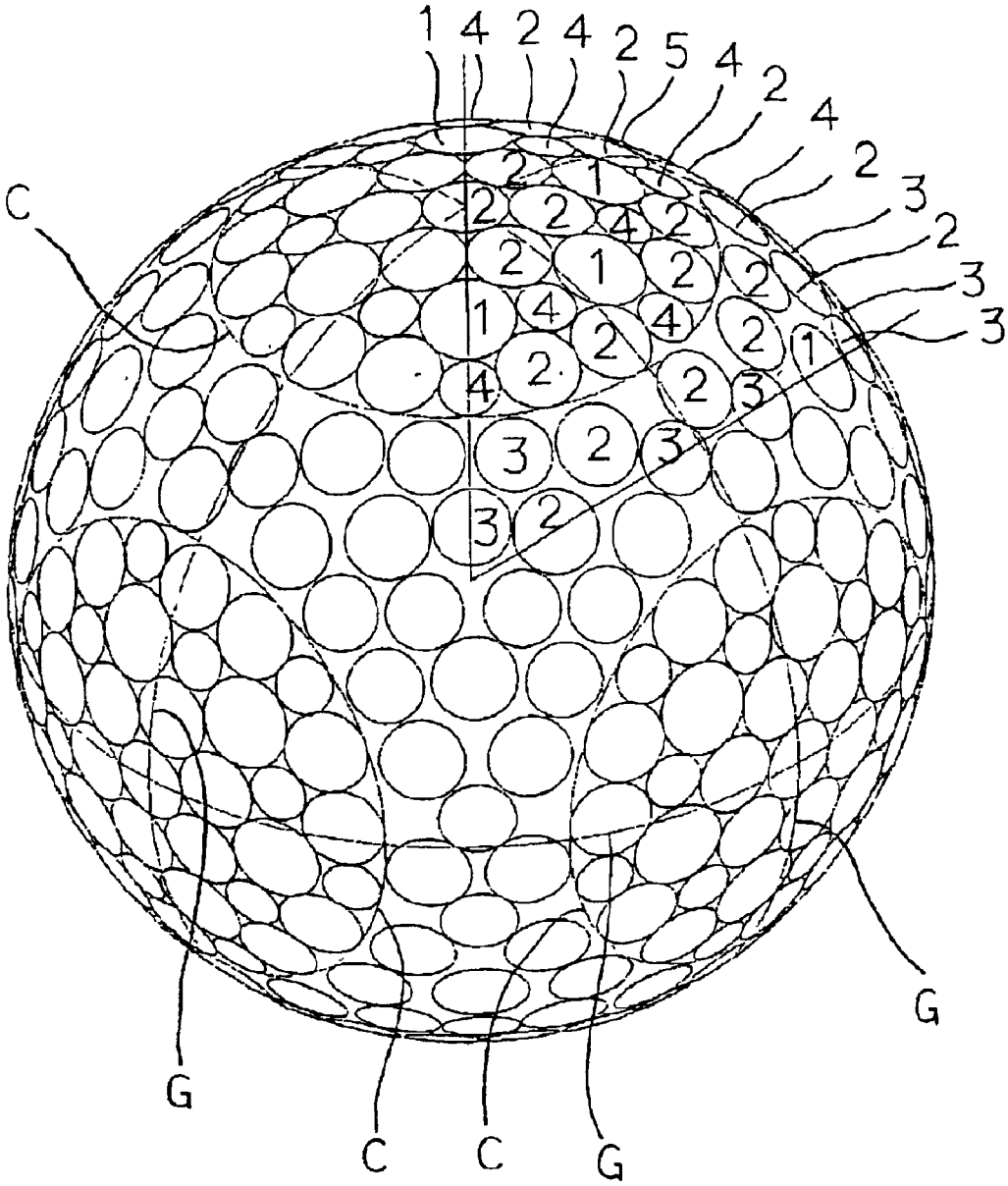
FIG. 1 is a plan view showing a golf ball according to an embodiment of the present invention.
Figure 2:
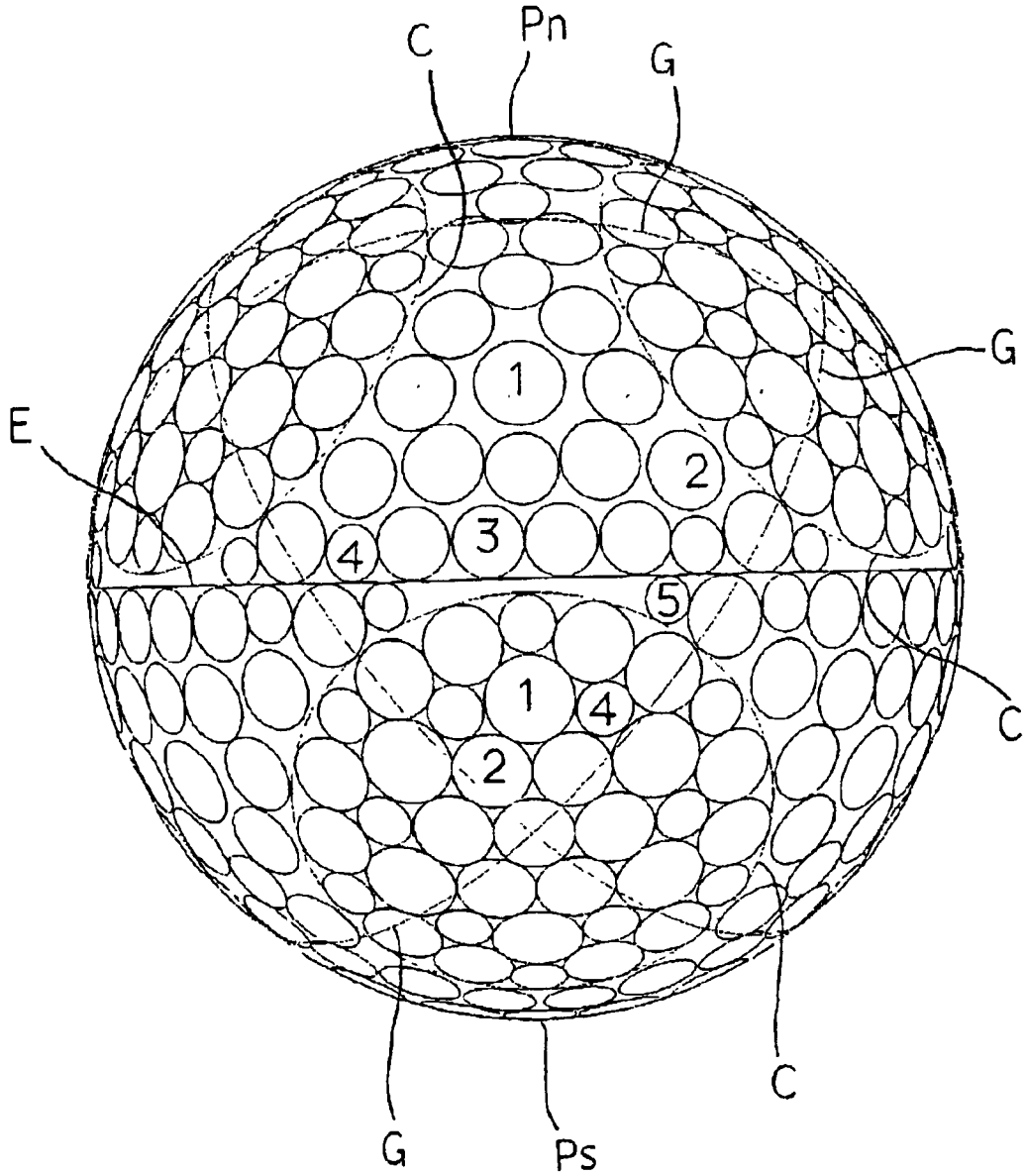
FIG. 2 is a front view showing the golf ball in FIG. 1.

The golf ball shown in FIGS. 1 and 2 usually has a diameter of 42.67 mm to 43.00 mm, particularly, 42.67 mm to 42.80 mm. The golf ball includes, on a surface thereof, a first dimple 1 having a diameter of 4.50 mm, a second dimple 2 having a diameter of 4.00 mm, a third dimple 3 having a diameter of 3.60 mm, a fourth dimple 4 having a diameter of 2.80 mm, and a fifth dimple 5 having a diameter of 2.30 mm. In FIG. 1, the type of dimple is indicated as a mark for one unit obtained by dividing a phantom spherical surface into 12 equal parts. The dimple pattern of the unit is developed into the whole phantom spherical surface so that a dimple pattern of the golf ball can be obtained. The number of the first dimples 1 is 42, the number of the second dimples 2 is 204, the number of the third dimples 3 is 60, the number of the fourth dimples 4 is 84, and the number of the fifth dimples 5 is 12. The total number of the dimples is 402. All the dimples are circular. More specifically, the shape of the dimple seen in the direction of a normal of the phantom spherical surface (a spherical surface obtained on the assumption that there is no dimple) is circular.

In the golf ball, the dimples are arranged by using a regular octahedron. In other words, a regular octahedron inscribed in a phantom spherical surface is assumed and the phantom spherical surface is comparted into eight spherical regular triangles by 12 comparting lines in which 12 sides of the regular octahedron are projected onto the phantom spherical surface, and the dimples are arranged for each spherical regular triangle. Four comparting lines are provided continuously so that three great circles are formed on the phantom spherical surface. In FIGS. 1 and 2, the great circle is indicated as G.

In FIG. 1, a circle assumed on the phantom spherical surface is indicated as C. A region surrounded by the circle C in the phantom spherical surface is a crown portion. The golf ball has six crown portions. A region in the phantom spherical surface other than the crown portions is a non-crown portion. The circle C is assumed such that the total area of all the crown portions and the area of all the non-crown portion are equal to each other. In this example, when the radius of a phantom sphere is represented by r, the radius of the circle C is set to $((11^{1/2}/6)*r)$. Each crown portion has an area of $(\pi r^2/3)$. Accordingly, the total area of the crown portions is $(2\pi r^2)$. The total area is half of the area of the phantom spherical surface $(4\pi r^2)$.

The dimples are arranged in the crown portion. Similarly, the dimples are arranged in the non-crown portion. The details are as follows.

| | Crown portions | Non-crown portion |
|---|---|---|
| First dimple 1 | 36 | 6 |
| Second dimple 2 | 114 | 90 |
| Third dimple 3 | 0 | 60 |
| Fourth dimple 4 | 72 | 12 |
| Fifth dimple 5 | 0 | 12 |
| Total | 222 | 180 |

The first dimple 1 has an area of 15.9 $mm^2$, the second dimple 2 has an area of 12.6 $mm^2$, the third dimple 3 has an area of 10.2 $mm^2$, the fourth dimple 4 has an area of 6.2 $mm^2$, and the fifth dimple 5 has an area of 4.2 $mm^2$. Accordingly, the dimples arranged in the six crown portions have a total area Sc of 2448.5 $mm^2$. If the radius r of the phantom sphere is 42.70 mm, the area of the phantom spherical surface is 5728.0 $mm^2$ and the total area of the crown portions is 2864.0 $mm^2$. Consequently, the ratio (a dimple occupation ratio Yc) of the total dimple area Sc to the total area of the crown portions is 85.5%. On the other hand, the dimples arranged in the non-crown portion have a total area Sn of 2030.4 $mm^2$. Since the area of the non-crown portion is 2864.0 $mm^2$, the ratio (a dimple occupation ratio Yn) of the total dimple area Sn to the area of the non-crown portion is 70.9%.

Thus, the dimples are dense in the crown portion and the dimples are sparse in the non-crown portion. In the golf ball, a region in which the dimples are dense and a region in which the dimples are sparse appear alternately by back spin during a flight. Consequently, the dimple effect of disturbing an air stream is promoted so that the flight distance of the golf ball can be increased. Even if the dimples are sparse in the crown portion and the dimples are dense in the non-crown portion, the same effect can be obtained.

The difference between the dimple occupation ratio Yc and the dimple occupation ratio Yn (an absolute value obtained by subtracting Yn from Yc) is set to be 5% to 30%. If the difference is smaller than the range, it is hard to obtain the effect of enhancing the flight performance depending on the denseness or sparseness of the dimples. From this viewpoint, the difference is more preferably 8% or more, and particularly preferably 10% or more. If the difference exceeds this range, there is the possibility that the occupation ratio in the region in which the dimples are sparse might be extremely reduced, resulting in an insufficient flight distance of the golf ball. In this respect, the difference is more preferably 27% or less, and particularly preferably 25% or less.

Figure 3:
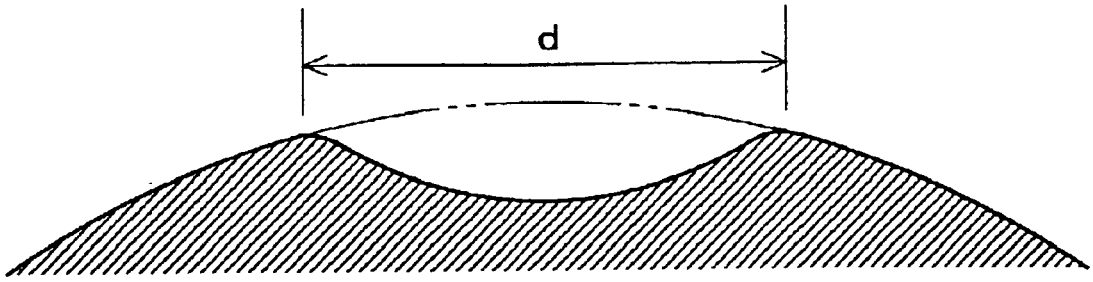
FIG. 3 is a typical enlarged sectional view showing a part of the golf ball in FIG. 1.

FIG. 3 is a typical enlarged sectional view showing a part of the golf ball in FIG. 1. In FIG. 3, a section passing through the deepest portion of a dimple is illustrated. In FIG. 3, a diameter of the dimple is shown in an arrow d. The diameter d represents a distance between both contacts in the case in which a common tangent line is drawn on both ends of the dimple. A dimple volume represents a volume of a portion surrounded by a phantom spherical surface (shown in a two-dotted chain line in FIG. 3) and a surface of the dimple.

An area of the dimple represents an area of a region surrounded by the contour of the dimple (that is, an area of a plane shape) when the center of the golf ball is seen at infinity. In the case of a circular dimple, an area s is calculated by the following equation.

$$s=(d/2)^2*\pi$$

In the case where the dimples are present across the crown portion and the non-crown portion, an area of a portion present on the inside of a circle C is added to a total area Sc and an area of a portion present on the outside of the circle C is added to a total area Sn.

In the golf ball shown in FIGS. 1 and 2, the areas of all the crown portions are equal to each other and the dimple patterns in all the crown portions are equivalent to each other. Consequently, the aerodynamic symmetry of the golf. ball is enhanced. The equivalency implies that two dimple patterns to be compared are equal to each other or are mirror image symmetrical with each other. In the golf ball shown in FIGS. 1 and 2, the dimple patterns in all the crown portions are identical to each other. Even if an original dimple is slightly moved or an original dimple size is slightly changed depending on a mold or a manufacturing error, the aerodynamic symmetry is maintained. In this specification, a state in which a slight movement or change is carried out in one or both of two dimple patterns which are originally equivalent to each other is referred to as "almost equivalent".

As is apparent from FIGS. 1 and 2, the center of the circle C is positioned in a portion in which a great circle G crosses another great circle G. In other words, the crown portion is placed in a position corresponding to the vertex of a regular octahedron. Six crown portions are distributed with an excellent symmetry over the phantom spherical surface. Consequently, the flight distance can be prevented from depending on the direction of the back spin.

A regular octahedron does not need to be assumed as a regular polyhedron. Any of a regular tetrahedron, a regular hexahedron, a regular dodecahedron and a regular icosahedron may be assumed. Even if any of the regular polyhedrons is assumed, the crown portion is positioned in a portion corresponding to a vertex thereof so that the aerodynamic symmetry can be enhanced. In the case in which the regular tetrahedron is assumed, four crown portions are present. In the case in which the regular hexahedron is assumed, eight crown portions are present. In the case in which the regular dodecahedron is assumed, 20 crown portions are present. In the case in which the regular icosahedron is assumed, 12 crown portions are present. A part of the vertexes may be set to be the non-crown portion within such a range that the aerodynamic symmetry is not damaged greatly. Moreover, the crown portion may be provided in both a portion corresponding to the vertex and other portions.

It is preferable that the number of the crown portions should be 2 to 24. If the number of the crown portions is less than this range, each crown portion has a large area so the desired dimple effect is obtained with difficulty. From this viewpoint, the number of the crown portions is more preferably four or more, and particularly preferably six or more. If the number of the crown portions exceeds the range, the area of each crown portion is reduced so that the desired dimple effect is obtained with difficulty. From this viewpoint, the number of the crown portions is more preferably 20 or less, and particularly preferably 12 or less.

The golf ball is usually formed by a mold including an upper mold and a lower mold which have hemispherical cavities, respectively. A parting line of the upper mold and the lower mold is a circle. A portion (a seam E) corresponding to the parting line in the surface of the golf ball is more peculiar in a dimple pattern as compared with other portions. When the seam E is assumed to be the equator of a globe, latitudes in all the crown portions are identical to each other. Thus, an excellent aerodynamic symmetry can be obtained except that the dimple pattern in the vicinity of the seam E is peculiar. The reason is that distances between the crown portions having latitudes identical to each other and a pole (Pn, Ps) are also equal to each other. In this specification, for example, a north latitude of 40 degrees and a south latitude of 40 degrees are referred to be equal to each other. It is also possible to provide a plurality of crown portions having latitudes identical to each other, i.e., a crown portion positioned on a north pole Pn and a crown portion positioned on a south pole Ps. Also in this case, an excellent aerodynamic symmetry can be obtained except that the dimple pattern in the vicinity of the seam E is peculiar. It is preferable that the total area of the crown portions present in a northern hemisphere and that of the crown portions present in a southern hemisphere should be equal to each other. In the case in which the crown portion is provided across the northern hemisphere and the southern hemisphere, it is preferable that the center of the crown portion should be positioned on the seam E. In this case, 50% of the area of the crown portion provided across the northern hemisphere and the southern hemisphere is added to the total area of the northern hemisphere and the residual 50% is added to the total area of the southern hemisphere. In the golf ball shown in FIGS. 1 and 2, the center of a plane of the regular octahedron thus assumed is positioned on the pole. Therefore, the latitudes of all the crown portions are identical to each other.

In the golf ball shown in FIGS. 1 and 2, the surface area occupation ratio Y of a total dimple area (4478.9 $mm^2$) to the area (5728.0 $mm^2$) of the phantom spherical surface is 77.0%. It is preferable that the surface area occupation ratio Y should be 70% to 90%. If the surface area occupation ratio Y is less than the range, there is a possibility that the dimples of the whole golf ball might become too sparse, resulting in an insufficient flight performance of the golf ball. From this viewpoint, the surface area occupation ratio Y is more preferably 72% or more, and particularly preferably 74% or more. If the surface area occupation ratio Y exceeds the range, the difference between the dimple occupation ratio Yc in the crown portions and the dimple occupation ratio Yn in the non-crown portion is apt to be insufficient. In this respect, the surface area occupation ratio Y is more preferably 88% or less, and particularly preferably 86% or less.

It is preferable that plural kinds of dimples having different sizes from each other should be provided in the crown portions. Similarly, it is preferable that plural kinds of dimples having different sizes from each other should be provided in the non-crown portion. By using a mixture of plural kinds of dimples, the air stream is effectively disturbed.

The dimension of the dimple is not particularly restricted and a diameter thereof is usually 1.5 mm to 5.5 mm, and particularly, 2.5 mm to 4.5 mm. The depth of the dimple (a distance between the phantom spherical surface and the deepest portion of the dimple) is usually 0.15 mm to 0.40 mm, and particularly, 0.20 mm to 0.5 mm. The sum of dimple volumes is usually 300 $mm^3$ to 700 $mm^3$, and particularly, 350 $mm^3$ to 650 $mm^3$. A non-circular dimple may be formed together with a circular dimple or in place of the circular dimple. As an example of the non-circular dimple, a plane shape is a polygon, an ellipse, an oval, a teardrop shape and the like.

All of the circle C, the great circle G and the seam E shown in FIGS. 1 and 2 are phantom lines and are drawn for convenience of the description. In an actual golf ball, these are not recognized as edges.

EXAMPLES

Example

A core formed of a solid rubber was put in a mold and an ionomer resin composition was subjected to injection molding to form a cover around the core. The surface of the cover was coated so that a golf ball according to an example 1 which has a dimple pattern shown in a plan view of FIG. 1 and a front view of FIG. 2 was obtained. The golf ball had an outside diameter of approximately 42.70 mm, a weight of approximately 45.4 g, a compression of approximately 85 (by an ATTI compression tester produced by Atti Engineering Co., Ltd.) and a total dimple volume of approximately 500 $mm^3$.

Comparative Example

Figure 4:
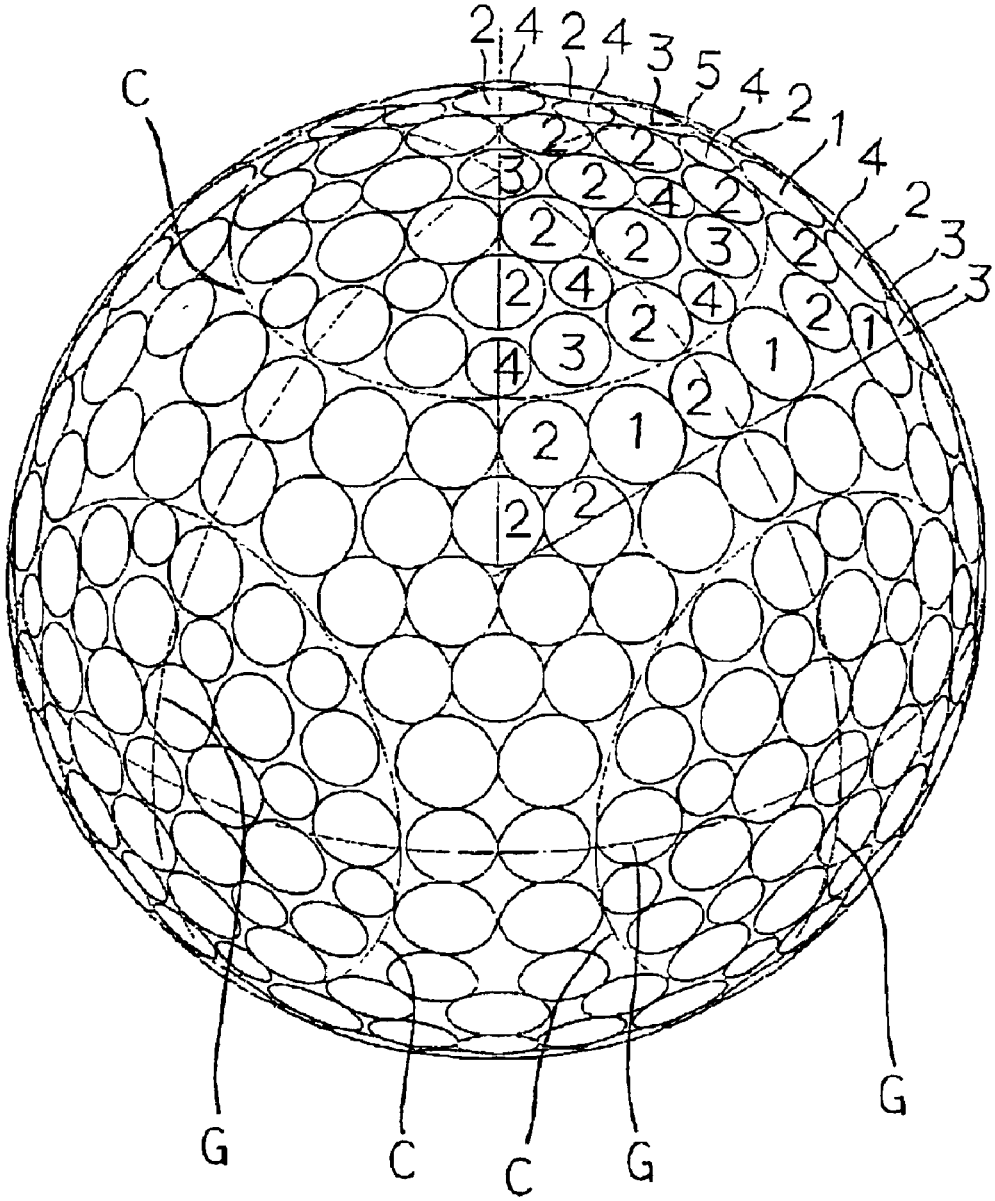
FIG. 4 is a plan view showing a golf ball according to a comparative example of the present invention.
Figure 5:
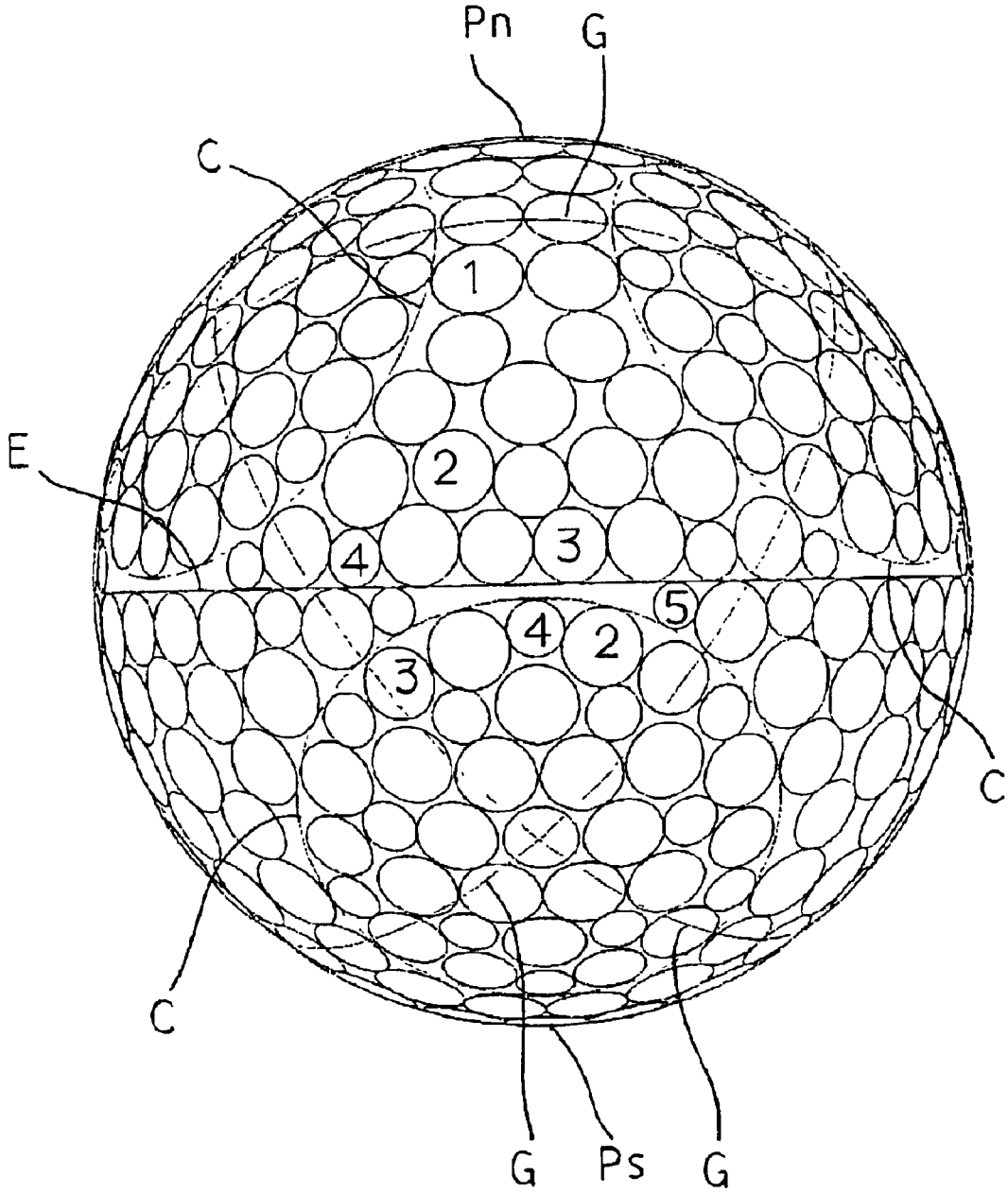
FIG. 5 is a front view showing the golf ball in FIG. 4.

A golf ball according to a comparative example which has a dimple pattern shown in a plan view of FIG. 4 and a front view of FIG. 5 was obtained in the same manner as in the example 1 except that the mold was changed. The golf ball includes, on a surface thereof, a first dimple 1 having a diameter of 4.50 mm, a second dimple 2 having a diameter of 4.00 mm, a third dimple 3 having a diameter of 3.60 mm, a fourth dimple 4 having a diameter of 2.80 mm, and a fifth dimple 5 having a diameter of 2.30 mm. The number of the first dimples 1 is 42, the number of the second dimples 2 is 204, the number of the third dimples 3 is 60, the number of the fourth dimples 4 is 84, and the number of the fifth dimples 5 is 12. The total number of the dimples is 402. All the dimples are circular. In the golf ball, the details of a dimple pattern obtained when a crown portions and a non-crown portion are assumed in the same manner as in the golf ball according to the example are indicated as follows.

| | Crown portions | Non-crown portion |
|---|---|---|
| First dimple 1 | 0 | 42 |
| Second dimple 2 | 108 | 96 |
| Third dimple 3 | 42 | 18 |
| Fourth dimple 4 | 72 | 12 |
| Fifth dimple 5 | 0 | 12 |
| Total | 222 | 180 |

In the golf ball according to the comparative example, a total area Sc of the dimples arranged in the six crown portions is 2228.0 $mm^2$. Accordingly, a ratio (a dimple occupation ratio Yc) of the total dimple area Sc to a total area of the crown portions (2864.0 $mm^2$) is 77.8%. On the other hand, the total area Sn of the dimples arranged in the non-crown portion is 2030.4 $mm^2$. Accordingly, a ratio (a dimple occupation ratio Yn) of the total dimple area Sn to an area of the non-crown portion (2864.0 $mm^2$) is 76.2%. A difference (Yc−Yn) between both the ratios is 1.6%. The golf ball has a surface area occupation ratio Y of 77.0%.

Flight Distance Test

Twenty golf balls according to each of the example and the comparative example were prepared. On the other hand, a driver (W1) comprising a metal head was attached to a swing machine produced by True Temper Co. and machine conditions were adjusted to have a head speed of approximately 49 m/s, a launch angle of approximately 11 degrees and a back spin speed of approximately 3000 rpm. Then, the golf ball was hit and a carry (a distance between a launch point and a drop point) and a total distance (a distance between the launch point and a stationary point) were measured. The following Table 1 shows the mean value of the results of measurement. During a test, a wind was almost fair and a mean wind velocity was approximately 1 m/s.

TABLE 1

Result of evaluation of golf ball

| | Example | Comparative Example |
|---|---|---|
| Number of dimples | | |
| Crown portions | 222 | 222 |
| Non-crown portion | 180 | 180 |
| Total area of dimples ($mm^2$) | | |
| Crown portions Sc | 2448.5 | 2228.0 |
| Non-crown portion Sn | 2030.4 | 2181.3 |
| Dimple occupation ratio (%) | | |

TABLE 1-continued

Result of evaluation of golf ball

| | Example | Comparative Example |
|---|---|---|
| Crown portions Yc | 85.5 | 77.8 |
| Non-crown portion Yn | 70.9 | 76.2 |
| Yc−Yn (%) | 14.6 | 1.6 |
| Carry (m) | 230.2 | 229.1 |
| Total flight distance (m) | 247.6 | 245.5 |

As shown in the Table 1, the golf ball according to the example has a greater flight distance than that of the golf ball according to the comparative example. From the results of evaluation, the advantage of the present invention is apparent.

The above description is only illustrative and can be variously changed without departing from the scope of the present invention.

What is claimed is:

1. A golf ball having a surface containing a large number of dimples thereon, said golf ball surface defining a phantom spherical surface containing a plurality of crown portions and non-crown portions distributed thereover, said crown portions having a total area which is one-half of the area of the phantom spherical surface, wherein the difference between the dimple occupation ratio Yc (%) in the crown portions and the dimple occupation ratio Yn (%) in the non-crown portions of (Yc−Yn) is 5% to 30%.

2. The golf ball according to claim 1, wherein the areas of all of the crown portions are equal to each other and dimple patterns of all the crown portions are almost equivalent to each other.

3. The golf ball according to claim 1, wherein all the crown portions are present in positions corresponding to vertexes of a regular polyhedron inscribed in the phantom spherical surface.

4. The golf ball according to claim 1, wherein a surface area occupation ratio Y of a total dimple area to the area of the phantom spherical surface is 70% to 90%.

5. The golf ball of claim 1, wherein the number of crown portions is 2 to 24.

6. The golf ball of claim 1, wherein the number of crown portions is 2 to 12.

7. The golf ball of claim 1, wherein a region in which the dimples are dense and a region in which the dimples are sparse appear alternately by back spin during the flight of the golf ball.

* * * * *